United States Patent [19]

Cutforth et al.

[11] Patent Number: 4,781,348

[45] Date of Patent: Nov. 1, 1988

[54] ADJUSTABLE BANDED ALUMINUM TRANSFORMER MOUNT

[75] Inventors: Steven R. Cutforth, Mexico; David P. Eppinger, Centralia; Daniel V. Hamilton, Centralia; J. Thomas Odom, Centralia, all of Mo.

[73] Assignee: A. B. Chance Company, Centralia, Mo.

[21] Appl. No.: 80,547

[22] Filed: Jul. 31, 1987

[51] Int. Cl.[4] ..... A47B 96/06

[52] U.S. Cl. ..... 248/218.4; 248/219.1; 211/26; 211/107

[58] Field of Search ..... 248/218.4, 219.4, 220.2, 248/219.1, 219.2, 219.3, 229, 230; 211/107, 26

[56] References Cited

U.S. PATENT DOCUMENTS

| | | | |
|---|---|---|---|
| 2,703,216 | 3/1955 | Petersen . | |
| 2,708,087 | 5/1955 | Blackstone . | |
| 2,761,643 | 9/1956 | Ward et al. . | |
| 2,879,964 | 3/1959 | Anderson et al. . | |
| 2,910,261 | 10/1959 | Ward et al. . | |
| 3,374,978 | 3/1968 | Salmon et al. . | |
| 3,497,171 | 2/1970 | Farmer et al. . | |
| 3,734,438 | 5/1973 | Kautz | 248/219.4 X |
| 3,750,992 | 8/1973 | Johnson | 248/219.4 X |
| 4,103,853 | 8/1978 | Bannan | 248/219.1 |
| 4,296,904 | 10/1981 | Farmer | 248/218.4 |

*Primary Examiner*—Ramon O. Ramirez

*Attorney, Agent, or Firm*—Hovey, Williams, Timmons & Collins

[57] ABSTRACT

A mounting assembly for supporting electrical apparatus such as transformers and the like on a utility pole includes spaced, equipment supporting brackets that are interconnected and secured to the pole by means of elongated, toothed plates. End regions of each plate extend through corresponding apertures in the brackets, and during assembly the end regions are shifted laterally and toward a narrowed portion of the aperture until a marginal edge section of the bracket next to the aperture enters a notch between adjacent teeth of the plate. The width of the narrowed aperture portion, being smaller than the overall width of the end regions of the plate except for the notches of the plate between adjacent teeth, prevents unintentional withdrawal of the plates from the brackets. A retaining spring, fixed to the bracket adjacent each aperture, ensures that the end region thereafter remains in place in the narrowed aperture portion in order to facilitate handling of the mounting assembly during installation.

7 Claims, 1 Drawing Sheet

FIG. 1
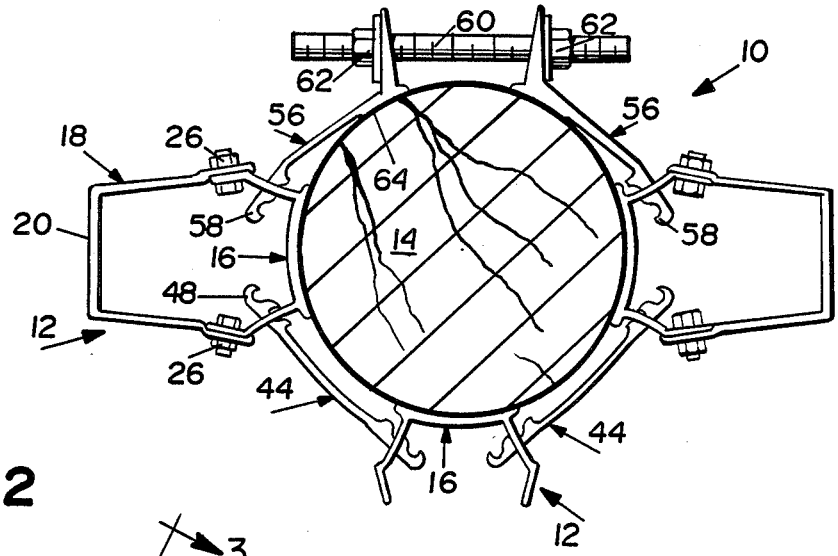
FIG. 2
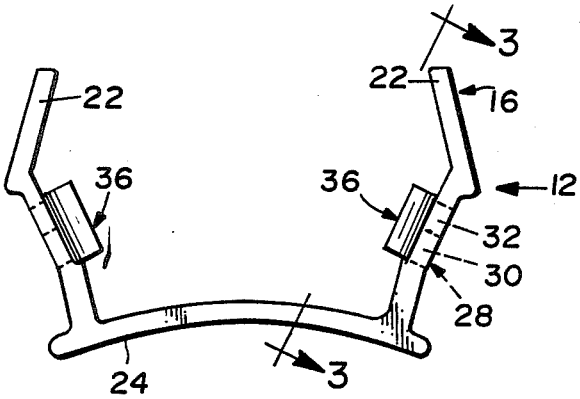
FIG. 3
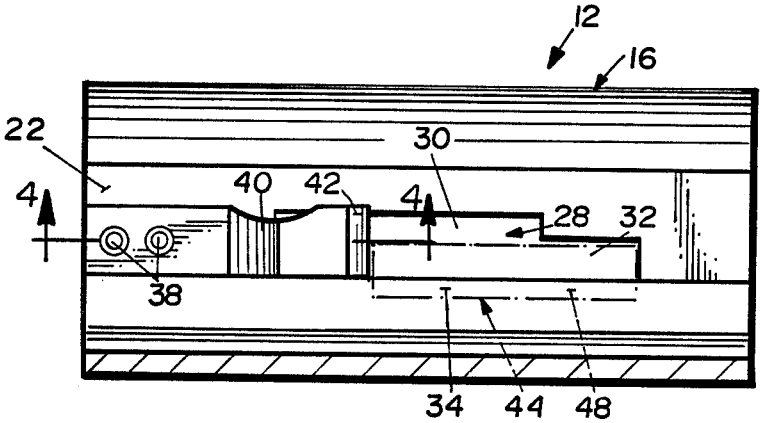
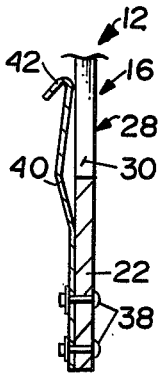
FIG. 4
FIG. 5
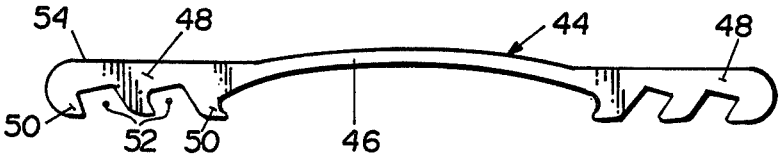

ADJUSTABLE BANDED ALUMINUM TRANSFORMER MOUNT

BACKGROUND OF THE INVENTION

1. Field of the Invention

This invention relates to an assembly for mounting electrical apparatus such as transformers or the like upon a utility pole, wherein the assembly includes a number of mounting brackets that are each adapted to support the apparatus as well as elongated members or plates that extend between the brackets and which have toothed end regions for enabling adjustment of the size of the assembly in accordance with the diameter of the selected utility pole. More particularly, the invention concerns a locking spring which is fixed to the bracket adjacent an L-shaped aperture in the bracket for retaining one of the toothed end regions of a plate partially within the confines of a narrower leg of the aperture, thereby preventing unintentional withdrawal of the plate from the aperture during installation of the assembly upon a utility pole.

2. Description of the Prior Art

Mounting devices for supporting electrical apparatus such as transformers and related equipment on a pole often include means for carrying one, two or three transformers at spaced locations around the periphery of the pole. Since the diameter of wooden utility poles may vary considerably from pole to pole, it is important that mounting devices or assemblies which extend around the circumference of the pole be adjustable in order to vary the size of the assembly to compensate for the diameter of the particular, selected pole. It is also desirable to construct such mounting assemblies from extruded aluminum components that are easy to assemble to a rigid, interlocking configuration and that are relatively light in weight so that the weight of the assembly and the equipment mounted thereon is minimized.

In the past, certain mounting assemblies which surround the pole and support a cluster of electrical devices such as transformers have been provided with a plurality of mounting brackets each adapted to support one of the transformers, as well as toothed members or plates which span the distance between adjacent brackets in order to mechanically interconnect the latter and retain the brackets in secure, fixed engagement with the pole. During assembly of the mount, the size or effective internal diameter of the mount may be varied to accommodate the diameter of the pole by longitudinally and laterally shifting one or more of the toothed plates relative to the corresponding brackets to enable a particular selected tooth of the plate to come into contact with the bracket. One example of this type of construction is shown in U.S. Pat. No. 3,374,978 dated Mar. 26, 1968.

The brackets which receive the toothed, interconnecting plates of prior art transformer mounting assemblies such as the type shown in U.S. Pat. No. 3,374,978 have apertures which are of a generally rectangular configuration that is complemental in configuration and slightly larger than the overall rectangular shape of the toothed region of the plate, so that the latter can be readily inserted into the aperture during assembly of the mount. U.S. Pat. No. 3,497,171 illustrates the provision of a separate retaining clip which is inserted behind the plate in the aperture once the plate is moved to a position causing one of the teeth to engage a marginal edge portion of structure defining the aperture, in order to reduce the likelihood of accidental disengagement of the selected tooth from the edge portion and withdrawal of the plate from the aperture of the bracket. Such clips are useful for maintaining the transformer mount in an assembled configuration during installation; once the assembly is mounted upon a pole and adjusting bolts are tightened to draw the mount into firm, surrounding contact with the pole, the teeth, being slightly inclined, subsequently remain in fixed, seating engagement with marginal edge portions of the brackets surrounding the aperture.

Unfortunately, a number of disadvantages have been associated with clips of the type illustrated in the aforementioned U.S. Pat. No. 3,497,171. For example, such clips are separate components which may be lost, or alternatively the linesmen may simply forget to install the clip in place. In addition, two hands are necessary for installing such clips, as the toothed regions of the plate must be maintained in proper disposition while the clip is inserted in the space between one side of the plate and a marginal edge of the bracket defining the aperture. Problems of this nature are somewhat compounded by the fact that the work is often undertaken in the field where suitable work surfaces are not available.

SUMMARY OF THE INVENTION

The present invention overcomes the problems noted above with regard to prior art devices by provision of a specially-configured aperture in the mounting bracket for receiving a toothed plate, as well as a locking spring which is secured to the mounting bracket and therefore cannot be accidentally dropped or lost. The toothed plate may be inserted into the aperture of the mounting bracket without manual manipulation of the locking spring, and once the plate is shifted to a desired position, the locking spring thereafter functions to substantially preclude unintentional withdrawal of the toothed plate from the mounting bracket.

In more detail, the structure of the mounting bracket defining the aperture presents a first aperture portion having a rectangular configuration slightly larger than the rectangular configuration of the toothed end region of the plate. A second aperture portion, open to the first aperture portion, is of a narrower rectangular configuration than the width of the first aperture portion and is only slightly larger in width than the relatively narrow dimension of the plate adjacent the notches and between adjacent teeth. Thus, the toothed end region of the member can be readily inserted into the first portion of the aperture and thereafter shifted laterally so that the toothed end region enters the narrower confines of the second aperture portion, causing one of the teeth to overhang a marginal edge of the bracket defining the slot and cause the tooth to be drawn into firm, seating contact with the bracket when the assembly is tightened to secure the latter to the pole.

The locking spring normally has an orientation partially covering the first or larger portion of the aperture. Upon installation of the toothed end region of the plate into the aperture, the locking spring deflects toward a second orientation substantially exposing the aperture so that the plate may be inserted into the aperture without the need for manual manipulation of the spring. Once the end region of the plate is shifted partially within the narrower confines of the second aperture portion, the inherent resiliency of the locking spring causes the latter to return to a first or normal orientation partially covering the first aperture portion and thereafter preventing unintentional shifting of the plate away from its captured position partially within the second aperture portion.

BRIEF DESCRIPTION OF THE DRAWINGS

FIG. 1 is a plan view of a utility pole and a mounting assembly constructed in accordance with a preferred embodiment of the invention, wherein is shown three brackets for supporting electrical equipment such as transformers, and toothed members or plates for securing the brackets to the pole;

FIG. 2 is an enlarged, plan view of a base of one of the mounting brackets which is shown in FIG. 1, along the two locking spring elements that are secured to the body;

FIG. 3 is an enlarged, side cross-sectional view taken along line 3—3 of FIG. 2 and illustrating the configuration of an aperture of the bracket as well as the disposition of the locking spring adjacent the aperture;

FIG. 4 is an enlarged, fragmentary, crosssectional view taken along line 4—4 of FIG. 3 to further reveal the shape and orientation of the locking spring; and FIG. 5 is an enlarged, plan view of one of the toothed plates which interconnects the mounting brackets that are shown in FIG. 1.

DETAILED DESCRIPTION OF THE DRAWINGS

A mount or assembly for supporting electrical apparatus such as transformers and related equipment is broadly designated by the numeral 10 and is illustrated in FIGS. 1–4 in accordance with a particularly preferred embodiment of the present invention. The assembly 10 has three brackets 12 which are provided for mounting the apparatus on a utility pole 14 typically made of wood.

Each of the brackets 12 is a subassembly comprised of a generally U-shaped base 16 and an oppositely oriented, generally U-shaped support 18 that presents an outwardly facing, planar mounting surface 20 to which the desired electrical apparatus is to be secured. In this regard, it should be noted that the center bracket 12 which is illustrated in FIG. 1 has not been provided with a support 18, as may be desirable when the remaining two brackets 12 are sufficient for supporting the selected electrical apparatus.

Referring now to FIGS. 2 and 3, each base 16 has two outwardly extending legs 22 that are integrally secured to a concave body 24 in a generally transverse relationship to the latter. An outermost portion of each leg has an aperture for receiving a nut and bolt assembly 26 (FIG. 1) which passes through corresponding legs of the associated support 18 for fixedly interconnecting the latter to base 16. The concave body 24 is adapted to be seated against the rounded periphery of pole 14 as is shown in FIG. 1.

Each leg 22 of the bracket base 16 includes structure which defines a generally L-shaped aperture 28. As depicted in FIG. 3, the aperture 28 has a first rectangular portion 30 of a certain width and a second rectangular portion 32 that is open to the first portion 30 and which has a width that is smaller than the width of the first aperture portion 30. The structure defining the aperture 28 includes a marginal edge section 34 which is adjacent the body 24 and which extends along the entire length of aperture 28, including the first aperture portion 30 and the second aperture portion 32.

A locking spring element 36, as illustrated in FIGS. 3 and 4, is rigidly secured to each leg 22 of body 24 by two rivets 38. The spring element 36 is comprised of a tempered, resilient material which may be readily bent by hand but which retains significant memory for purposes which will be explained hereinunder. The spring element 36 includes a narrowed or necked down central portion 40 (FIG. 3) as well as a hook-shaped end portion 42 (FIGS. 3 and 4).

Viewing FIG. 1, the assembly 10 includes two elongated members or hook plates 44 which extend partially around the periphery of the pole 14 for interconnecting adjacent brackets 12 and securing the same as well as any electrical apparatus coupled thereto to the pole 14. As is shown in more detail in FIG. 5, each of the hook plates 44 includes a slightly curved central region 46 and two end regions 48, 48 disposed on opposite sides of the central region 46.

The end regions 48 have walls defining three teeth 50 which are spaced apart by corresponding notches 52 that extend in a direction transverse to the longitudinal axis of the member or plate 44. The plate 44, including both end regions 48 as well as the central region 46, presents a rectangular configuration in cross-section transverse to the longitudinal axis of plate 44, with the longer dimension of the rectangular configuration extending in a direction perpendicular to the plane of the drawing.

The end region 48 presents an overall width (i.e., in a direction transverse to the longitudinal axis of hook plate 44 and parallel with the plane of the drawing in FIG. 5) that is complemental and only slightly smaller than the width of the first aperture portion 30. The end region 48 of the hook plate 44 also presents a reduced width adjacent each of the notches 52 which is represented by the transverse distance between a flat, rear surface 54 of the end region 48 and the bottom of the directly adjacent notch 52. The aforementioned reduced width of the end region 48 is complemental and slightly smaller than the width of the second aperture portion 32.

Finally, the assembly 10 also includes two take-up members or plates 56 which are shown in FIG. 1 and which each include end regions 58 that present toothed configurations substantially identical to the toothed configuration of the end regions 48 of hook plates 44. Each take-up plate 56 has an outwardly extending leg having an opening which receives a threaded adjustment bolt 60 that extends through the opening in the adjacent, opposed take-up plate 56. Nuts 62 are threadably received on each end of the bolt 60 and, when tightened, secure the assembly 10 to pole 14 by drawing up each of the curved bodies 24 as well as contact surfaces 64 of take-up plates 56 into a position of fixed, seating engagement with corresponding regions of the pole 14.

The overall width of either of the end regions 48, 58, being slightly smaller than the width of the first aperture portions 30, enables insertion of the end regions 48, 58 through the corresponding apertures 28 during assembly of the mount 10. Once each of the end regions 48, 58 is shifted longitudinally to bring one of the notches 52 into a location adjacent the marginal edge sections 34 of the bracket bodies 24, the end regions 48, 58 are shifted laterally to bring the marginal edge section 34 within the notch 52 and between adjacent teeth 50. Thereafter, the end region 48, 58 is shifted laterally in a second direction along the length of the marginal edge section 34, for enabling the end regions 48, 58 to move toward a certain position at least partially within the second portion 32 of aperture 28.

In accordance with the principles of the present invention, the overall width of the end regions 48, 58, being larger than the width of the second aperture portion 32, enables the teeth 50 to substantially preclude unintentional withdrawal of the end region 48, 58 from the aperture 28 of the body 24 when the end region 48, 58 is in the aforementioned, certain position partially within the second aperture portion 32. In this manner, the inherent configuration of the aperture 28, in cooperation with the notched or toothed configuration of the end regions 48, 58 reliably and sturdily interconnects the plates 44, 56 and the respective bracket bodies 24.

The spring element 36 is biased toward a normal or first orientation partially covering the first aperture portion 30 as is shown in FIGS. 3 and 4. The end region 48 of plate 44 is shown in phantom lines in FIG. 3, and it can be appreciated that the hook-shaped end portion 42 of the spring element 36 prevents the end region 48 from sliding toward a position fully within the second aperture portion 30. Thus, the spring element 36 functions as a means for retaining the end region 48, 58 in a position partially within the second aperture portion 32.

The inherent resiliency of the locking spring element 36 enables the latter to shift to a second orientation substantially exposing the first aperture portion 30, so that the end region 48, 58 may be inserted or withdrawn from the aperture 28. In this regard, during assembly of the mount 10, end region 48, 58 is inserted through the first aperture portion 30 until reaching a position of contact with the spring element 36, and thereafter further shifting of the end region 48, 58 in the same direction will deflect the narrowed central portion 40 of the spring element 36 to cause the latter to bend to its second orientation thereby enabling further insertion of the end region 48, 58.

The hook-shaped end portion 42 of the locking spring element 36 is manipulable by hand when necessary to move the spring element 36 away from the first aperture portion 30, as may be desired when, for instance, it is necessary to withdraw the plate 44, 56 or shift the same until a different notch 52 is brought into adjacent relationship with marginal edge 34. However, as soon as the end region 48, 58 is shifted laterally to its position partially within the second aperture portion 32, the inherent resiliency of the spring element 36 causes the same to return to its first or normal orientation partially covering the first aperture portion 30 and thereby precluding further shifting and accidental withdrawal of the end region 48, 58 from the aperture 28.

As can now be appreciated by those skilled in the art, the provision of the L-shaped, or "two-stage" aperture 28, in combination with the locking spring element 36, provides secure retention of the toothed plates 44, 56 during assembly of the mount 10 without the need for separate components which may be otherwise lost or forgotten. Moreover, fabrication of the assembly 10 is simplified inasmuch as the end regions 48, 58 merely be inserted in place within apertures 28 without the necessity of manual manipulation of the spring element 36. Normally, components such as the brackets 12 and plates 44, 56 are extruded from lightweight, aluminum materials and therefore practice of the present invention advantageously does not increase the overall weight to the amount 10 to any significant degree.

We claim:

1. An assembly for mounting electrical apparatus for on a utility pole comprising:

at least one bracket having means adapted to be coupled to said electrical apparatus for supporting the latter in elevated disposition relative to the ground, said at least one bracket including structure defining an aperture presenting a first portion having a first, certain width and a second portion open to a said first portion and having a second, certain width smaller than said first, certain width;

at least one elongated member extending partially around the periphery of said pole for securing said bracket and thereby any electrical apparatus coupled thereto to said pole, said at least one member having an end region extending through said aperture, said end region having walls defining at least one notch extending in a direction generally transverse to the longitudinal axis of said member, said end region having an overall width complemental to said width of said first portion of said aperture for enabling insertion of said end region through said aperture, said end region having a reduced width adjacent said at least one notch, said reduced width being complemental to said width of said second portion of said aperture, for enabling movement of said walls of said end region defining said notch from a position in said first portion of said aperture and toward a certain position at least partially within said second portion of said aperture; and means for retaining said walls of said end region defining said notch in said certain position at least partially within said second portion of said aperture, said overall width of said end region being larger than said certain width of said second portion of said aperture for substantially precluding unintentional withdrawal of said end region of said member from said aperture when said end region is in said certain position at least partially within said second portion of said aperture, said means for retaining said walls in said certain position comprising a resilient spring element.

2. The invention as set forth in claim 1, wherein said spring element is biased toward a first orientation partially covering said first portion of said aperture for retaining said walls of said end region in said certain position, and is also shiftable toward a second orientation substantially exposing said first portion of said aperture for enabling insertion of said end region of said member in said aperture.

3. The invention as set forth in claim 2, wherein said spring element includes a finger manipulable, hook-shaped portion for enabling shifting of said spring element from said first orientation and toward said second orientation for selective withdrawal of said member from said aperture.

4. The invention as set forth in claim 1, wherein said spring element is fixed to said at least one bracket adjacent said structure defining said aperture.

5. The invention as set forth in claim 1, wherein said end region of said member has at least two notches thereby presenting a toothed configuration in directions transverse to the longitudinal axis of said member and enabling selective longitudinal adjustment of the disposition of said member relative to said at least one bracket as may be necessary to accommodate the assembly to the diameter of said pole.

6. The invention as set forth in claim 1, wherein said end region of said member presents a generally rectangular profile in directions perpendicular to the longitudinal axis of said member, said first portion of said aperture has a generally rectangular configuration, and said second portion of said aperture has a generally rectangular configuration and extends in a direction away from said first portion of said aperture, said first portion of said aperture and said second portion of said aperture combining to present a generally L-shaped configuration.

7. An assembly for mounting electrical apparatus for on a utility pole comprising:

at least one bracket having means adapted to be coupled to said electrical apparatus for supporting the latter in elevated disposition relative to the ground, said at least one bracket including structure defining an aperture presenting a first portion having a first, certain width and a second portion open to a said first portion and having a second, certain width smaller than said first, certain width;

at least one elongated member extending partially around the periphery of said pole for securing said bracket and thereby any electrical apparatus coupled thereto to said pole, said at least one member having an end region extending through said aperture, said end region having walls defining at least one notch extending in a direction generally transverse to the longitudinal axis of said member, said end region having an overall width complemental to said width of said first portion of said aperture for enabling insertion of said end region through said aperture, said end region having a reduced width adjacent said at least one notch, said reduced width being complemental to said width of said second portion of said aperture, for enabling movement of said walls of said end region defining said notch from a position in said first portion of said aperture and toward a certain position at least partially within said second portion of said aperture; and means for retaining said walls of said end region defining said notch in said certain position at least partially within said second portion of said aperture, said overall width of said end region being larger than said certain width of said second portion of said aperture for substantially precluding unintentional withdrawal of said end region of said member from said aperture when said end region is in said certain position at least partially within said second portion of said aperture, wherein said retaining means is secured to said bracket, normally partially covers said first portion of said aperture, and is deflectable by said end region of said member toward a position away from said aperture as said end region of said end member is inserted in said aperture.

* * * * *